United States Patent [19]

Rothbart

[11] Patent Number: 4,733,593

[45] Date of Patent: Mar. 29, 1988

[54] MIXED METER METRONOME

[76] Inventor: Peter Rothbart, 115 Troy Rd., Ithaca, N.Y. 14850

[21] Appl. No.: 28,187

[22] Filed: Mar. 19, 1987

[51] Int. Cl.[4] ..... G10B 15/00

[52] U.S. Cl. ..... 84/484; 84/DIG. 12

[58] Field of Search ..... 84/470 R, 484, DIG. 12

[56] References Cited

U.S. PATENT DOCUMENTS

| | | | |
|---|---|---|---|
| 3,406,604 | 10/1968 | Stickley et al. | 84/484 |
| 3,534,649 | 10/1970 | Anderson | 84/484 |
| 3,554,073 | 1/1971 | Castilloux | 84/484 |
| 3,664,225 | 5/1972 | Robertson | 84/484 |
| 4,014,167 | 3/1977 | Hasegawa et al. | 84/484 |
| 4,154,132 | 5/1979 | Mishima | 84/DIG. 12 |
| 4,193,257 | 3/1980 | Watkins | 84/484 |
| 4,242,936 | 1/1981 | Swain | 84/DIG. 12 |
| 4,256,005 | 3/1981 | Mishima | 84/DIG. 12 |
| 4,292,874 | 10/1981 | Jones et al. | 84/DIG. 12 |
| 4,357,854 | 11/1982 | Hirano | 84/DIG. 12 |
| 4,380,185 | 4/1983 | Holcomb | 84/DIG. 12 |
| 4,467,690 | 8/1984 | Nishimoto | 84/DIG. 12 |
| 4,583,443 | 4/1986 | Senghaas | 84/484 |
| 4,630,519 | 12/1986 | Hirano | 84/DIG. 12 |

*Primary Examiner*—L. T. Hix
*Assistant Examiner*—David Porterfield
*Attorney, Agent, or Firm*—James & Franklin

[57] ABSTRACT

A microprocessor-controlled metronome in which the type (strong or weak), pattern (order and number of strong and weak) and frequency of beats are determined by data stored in a memory manually programmable by means of a keyboard or the like and capable of storing information to produce metronome beats of different types, patterns and relative frequencies combined in various sequences to produce metronome passages consisting of one or more of those sequences, the memory being capable of storing a plurality of such passages and to produce beats corresponding thereto on command.

13 Claims, 6 Drawing Figures

MIXED METER METRONOME

This invention relates to a metronome capable of producing beats of mixed meter in varying time intervals as desired, thereby to provide playing guidance for virtually unlimited types of musical passages.

Metronomes are time-keeping devices used primarily by musicians during practice sessions in order to produce a series of beats (usually but not necessarily audible) to which the musician attempts to synchronize his playing. In the past musical compositions were generally of uniform tempo, in which the pulse of the music varied virtually not at all (except for ritards and accelerations) from measure to measure, and hence metronomes could be, and were, very simple, capable of producing a series of uniformly spaced beats at one particular tempo which could be selected by the musician. However, much music in the past century contains passages where the pulse varies from measure to measure or every few measures. For example, the pulse may be at 60 beats per minute, then suddenly shift to 84 beats per minute and then shift again, this time to 72 beats per minute. Conventional metronomes cannot do this. They must be manually set each time one wishes to change the beats per minute, and hence they cannot be used effectively with such modern music.

The advent of the computer has made possible the production of electronic metronomes capable of being programmed to produce different rhythms over time, but they have been relatively complex, and in general have been capable of producing only a single program of beats, their memories being designed to contain at any given moment only that particular program. In particular, none of those prior art metronomes, so far as I am aware, are capable of being readily programmed with virtually unlimited flexibility to produce a sequence of beats of various meters in readily variable time periods.

When a musician is presented with a new piece of modern meter complexity he needs an instrument which will give him the proper beats for that particular piece, and when he then turns to a second piece with a completely different meter schedule he needs a metronome that can assist him with that meter schedule. The metronomes of the prior art, including computerized metronomes, so far as I am aware, have not had the capability of meeting that problem. The metronome here disclosed does have that capability, and consequently is highly superior to all of the prior metronomes that I am aware of.

In the metronome here disclosed and claimed the pattern of beats is controlled by a readily programmable memory. For each sequence of beats (and I here define "sequence" as that part of the musical passage in which the tempo remains the same, that is to say, in which the smallest metrical value does not change) there is stored in the memory, by means of an appropriate keyboard or the like, data determining the relative frequency of the beats to be produced and the pattern of strong/weak beats that is wanted, which pattern can vary throughout the sequence as determined by part of the corresponding musical selection. When the tempo of a passage being being programmed changes (the time to be occupied by the smallest rhythmic value) a separate sequence of beats (frequency and pattern) is inserted into memory in a second location. The number of beats or sets of beats in each sequence can be varied widely. The process is repeated until all of the sequences (of different tempi) have been inserted into memory. It is significant that placing the data into memory is accomplished in a fashion entirely independent of the actual rhythms and frequencies involved.

The individual sequences may then be linked in the memory to produce the entire rhythmic beat program for a complete musical passage. In its preferred form, the memory is capable of retaining data to produce the beat programs for a plurality of individual passages each made up of a plurality of sequences all of which may be different one from the other.

After the memory has been programmed, the musician can select a given passage or a given sequence or plurality of sequences within a given passage, and the metronome will then produce the corresponding beat pattern at the present relative tempo. If the musician finds one or more sequences particularly difficult to master the metronome can, upon command, produce the beat pattern for that sequence or sequences over and over again, so that the musician can, through repetition, master the piece. This ability of the metronome to pick out only a selected part of a given pattern in memory, and to play it either once or repetitively as desired, is an important learning aid.

The metronome also has an overall tempo control capable of increasing or decreasing the actual time involved for all of the tempo data in the memory. Thus, while the tempo data in the memory, as stated, determines the relative relationship between the tempi of the various sequences, the overall tempo control determines the actual period of time allotted to each of the beats, speeding up or slowing down all of the beats while retaining their desired relative relationship as determined by the tempo data in the memory. Thus, a musician can begin to learn a piece while playing it slowly and can then, as his facility increases, play it more and more rapidly without departing from the complex metrical arrangement of the passage, and the metronome can assist him in so doing, without having to reprogram the memory, simply by changing the overall tempo control.

From this, it may be seen that the metronome of the present invention can be programmed by the musician to assist him in learning to play one or more musical passages, and when he has mastered those passages and turns to other passages with different metrical requirements, he need merely reprogram the memory of the metronome and it is then ready to assist him in his new musical tasks.

Most music calls for combinations of strong and weak beats, with those combinations often changing in the course of a given passage. Sophisticated metronomes of the prior art have been capable of producing strong and weak beats in various fixed combinations. With the metronome of the present invention, the particular pattern or sequence of strong and weak beats is keyboard-programmed into the metronome's memory, but significantly only by sequential identification of the type of beat (strong/weak) independently of the actual time relationship of the beat type commands as they are keyed in. This greatly facilitates the production of accurately timed beats in the desired pattern, the metronome determining the timing and not requiring the programmer to produce that timing. (This has been done in the past, in connection with other metronome systems.) Furthermore, as the musician's facility with a given piece increases, his need to hear all of the beats decreases, and accordingly my metronome can be controlled to produce either the full collection of strong and weak beats or only the strong beats, this being accomplished without affecting the memory at all, so that the metronome can, if desired, make only the strong beats and then immediately resume both the strong and the weak beats for a given passage.

In many selections a given sequence appearing at one point in the passage is repeated at some later point in the passage. In my metronome, once a given beat sequence has been placed in one location in memory, it may be copied into another location in memory without having to key the entire sequence into that other location and without adversely affecting the memory storage of that given sequence in said one location. This feature significantly facilitates programming the metronome for a given musical selection.

The prime object of the present invention is to devise a metronome that can be readily programmed to produce beat sequences for a given mixed meter musical selection.

It is another object of the present invention to devise such a metronome in which a keyboard or the like may be used to insert data into the metronome memory so that the memory may be readily programmed to correspond to a musical piece.

It is a further object of the present invention to devise a mixed meter metronome capable of being programmed for a plurality of sequences of different basic tempo, which sequences may then be linked together for sequential actuation to produce beats for a complete musical passage comprising those sequences.

It is yet another object of the present invention to devise a simple, easily transportable and easily actuatable and controllable metronome which will provide optimum mixed meter beat sequences, thereby to assist the musician in learning musical pieces with many different tempo and rhythm requirements.

It is a further object of the present invention to provide a metronome that allows the musician to program individual tempos and strong/weak beats, to link them together to rehearse any mixed meter passage, and to vary the playback tempo, so that the musician may develop more efficiently and rapidly.

To the accomplishment of the above, and such other objects as may hereinafter appear, the present invention relates to the construction and mode of operation of a mixed meter metronome as defined in the appended claims and as described in this specification, taken together with the accompanying drawings, in which:

Figure 1:
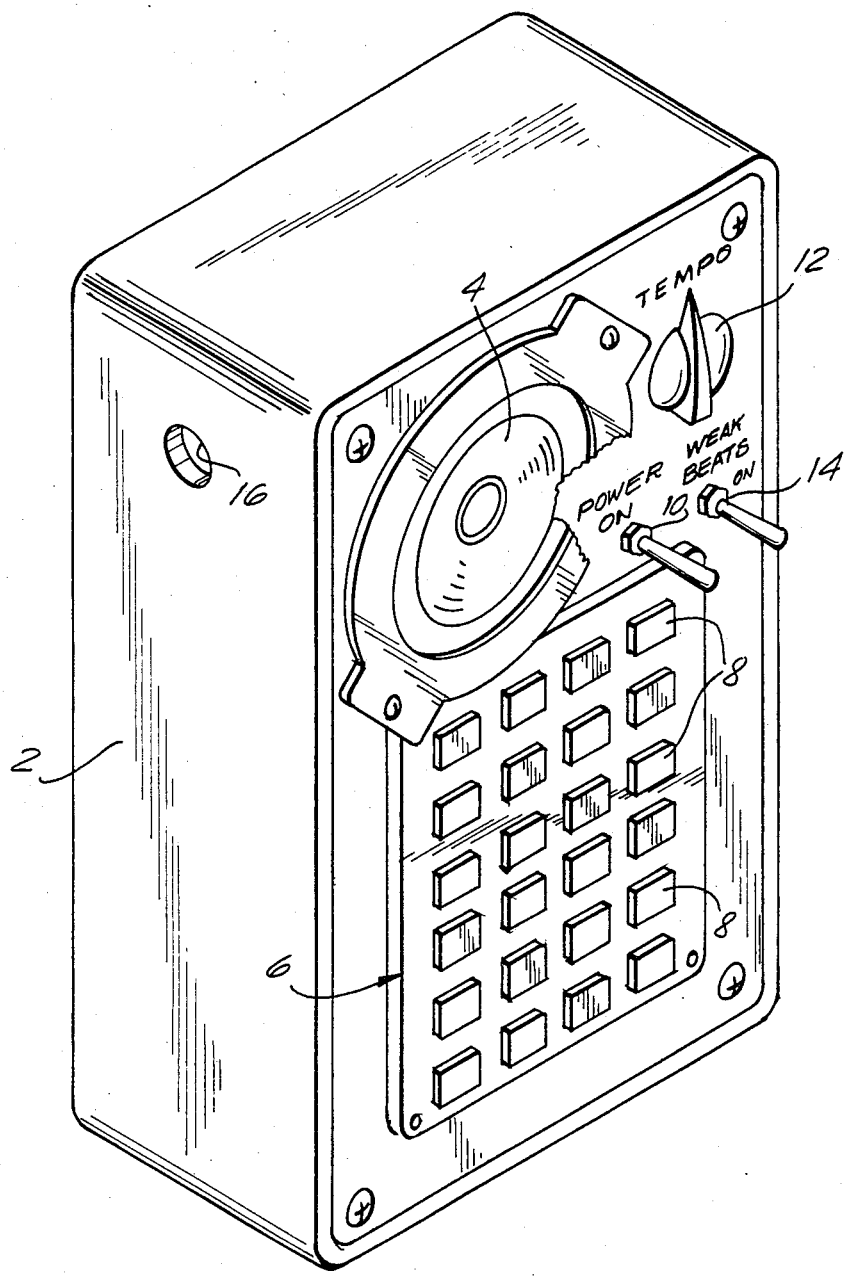
FIG. 1 is a three-quarter perspective view of a typical embodiment of the metronome of the present invention.
Figure 2:
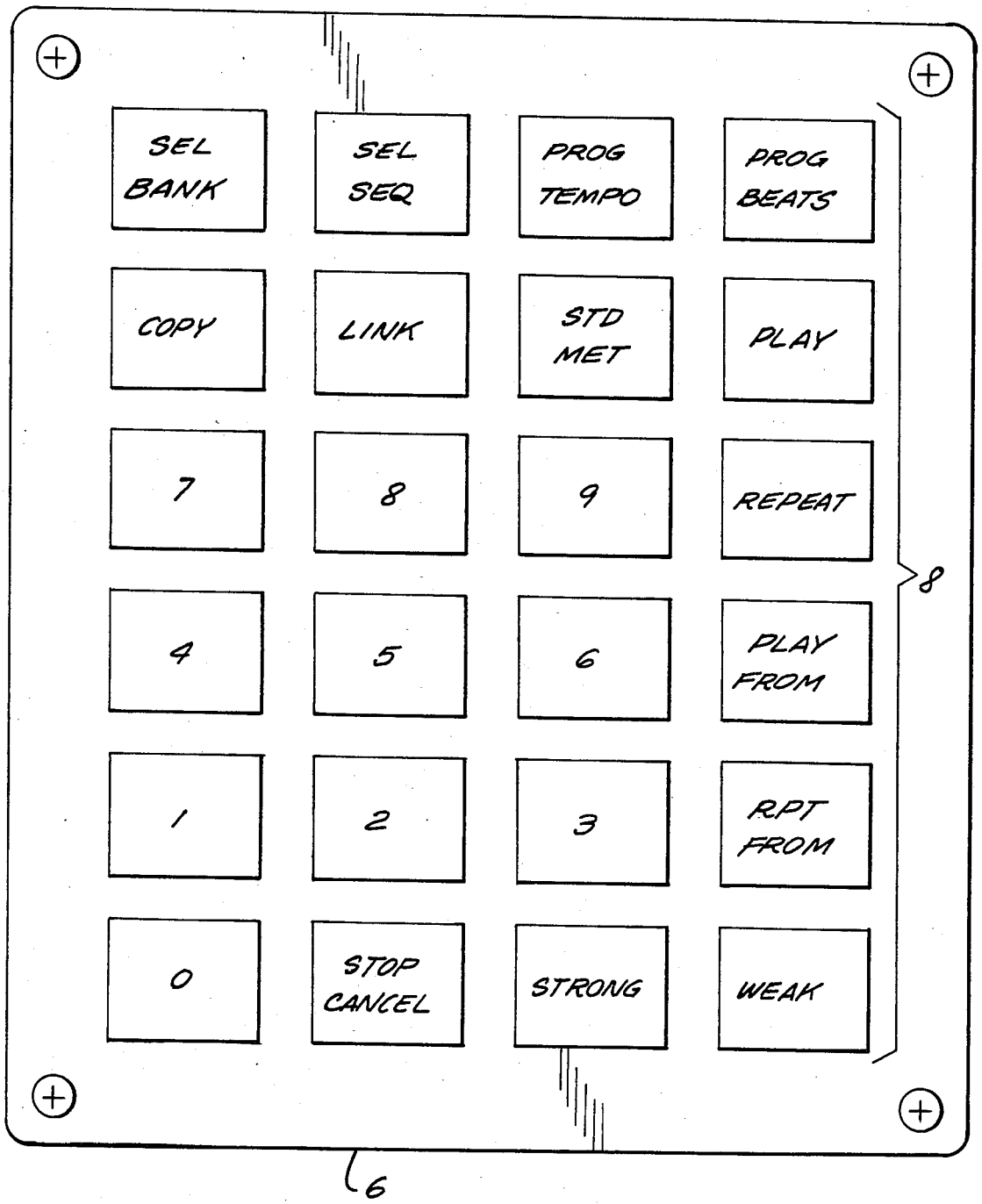
FIG. 2 is an enlarged plan view of the keyboard thereof, showing the significance of the various keys thereof.

The electrical components of the metronome of the present invention may be housed within a casing 2 approximately six inches long, three and one-half inches wide and two inches high, a size that is convenient to handle and to carry from place to place. Externally exposed on the casing 2 is a speaker 4 which produces the sounds that constitute the audible beat output of the device. The front face of the casing 2 carries a keyboard generally designated 6, here shown as carrying twenty-four keys 8 in the form of manually actuatable push buttons. Also located on the front face of the housing 2 is a power switch 10, a tempo control knob 12 and a "weak beats" switch 14. The housing 2 may contain batteries for energizing the metronome, and a side wall may be provided with an opening 16 through which electrical connection to an external AC converter or other source of DC power may be inserted.

Figure 3:
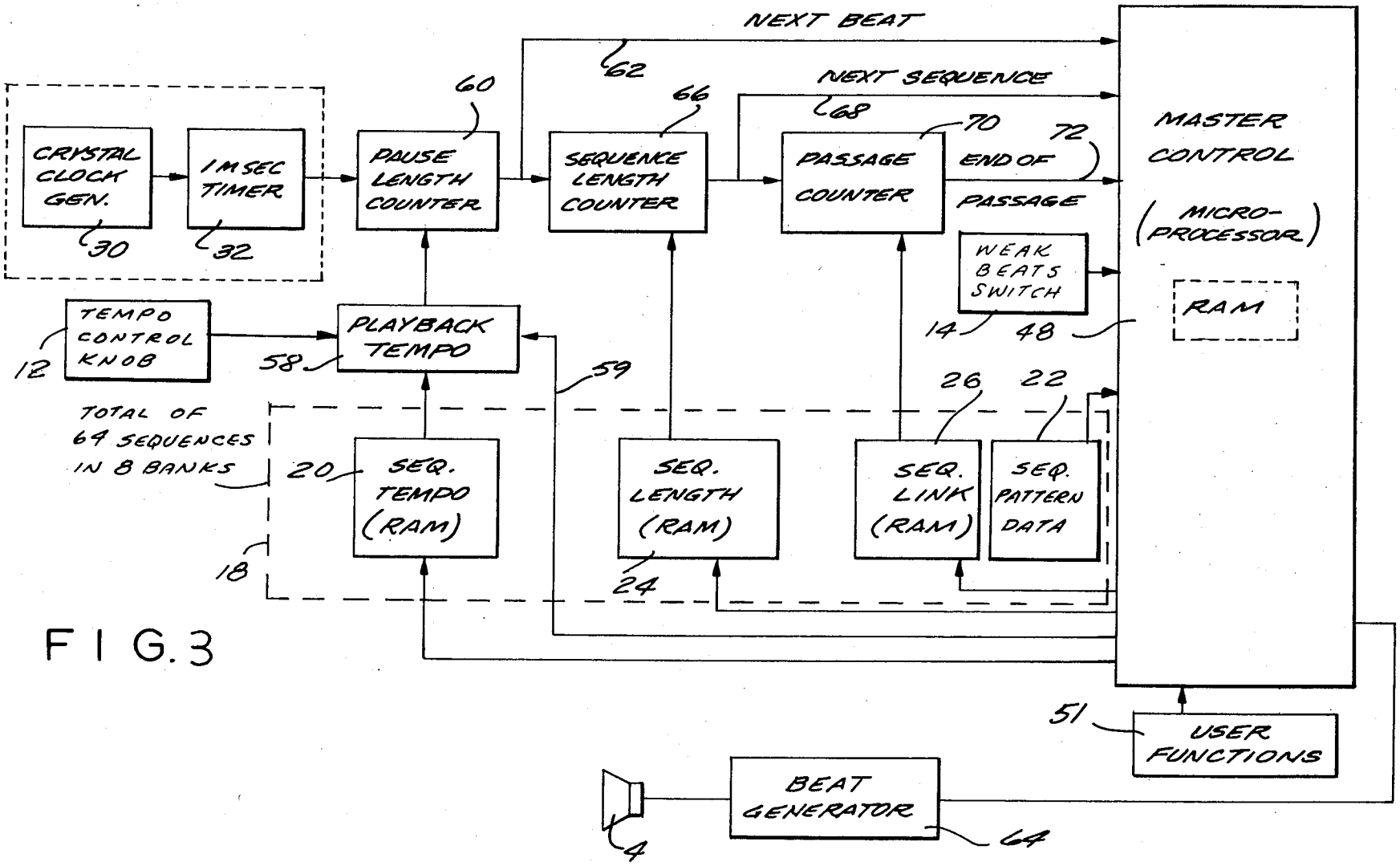
FIG. 3 is a block diagram of the functioning portions of the metronome.
Figure 4:
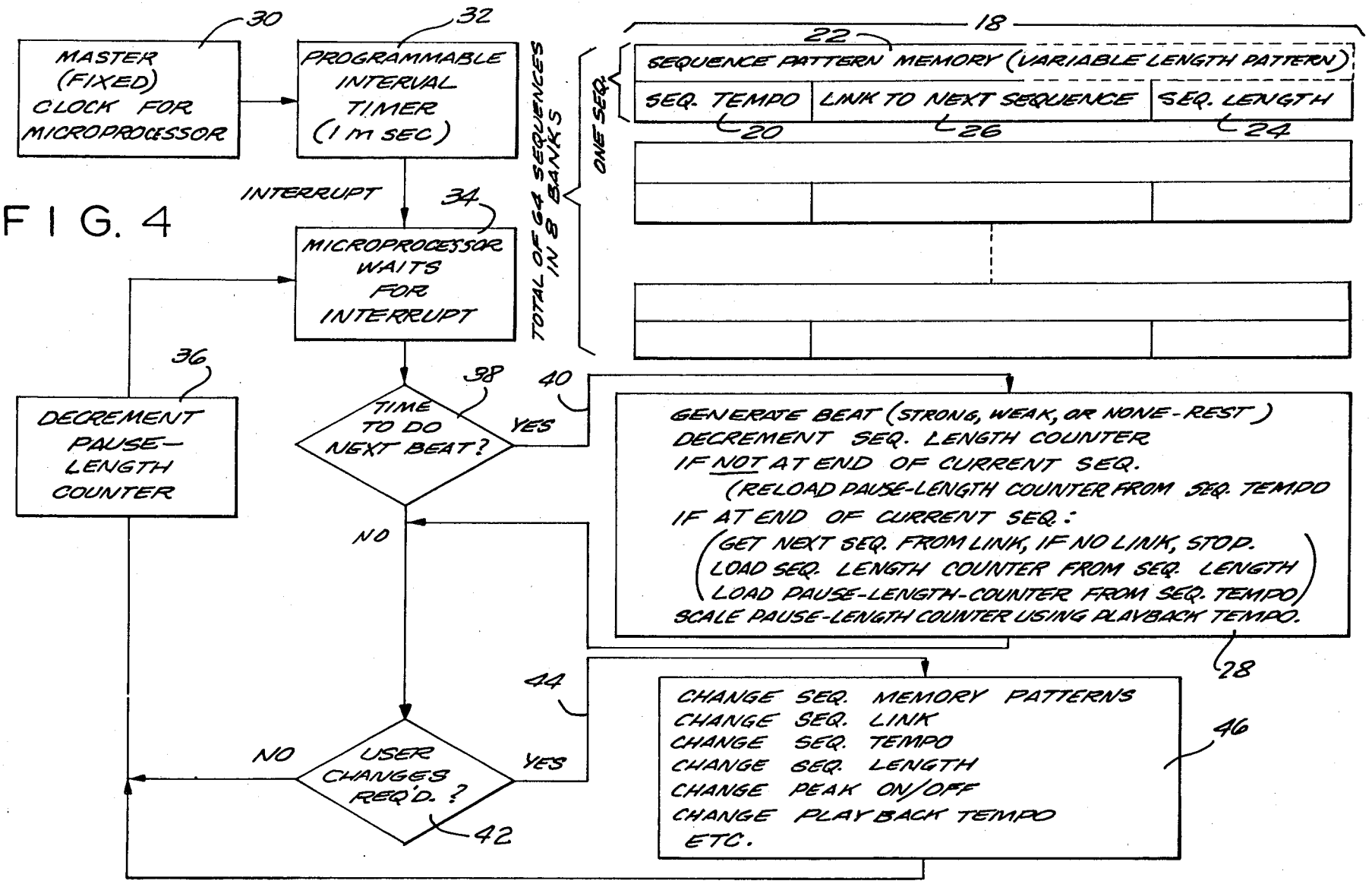
FIG. 4 is a function or logic diagram illustrating the manner in which the computer components of the metronome function, combined with, in the upper right-hand corner, a representation of a memory organization for beat sequences.

The metronome is provided with a programmable memory generally designated 18 (see FIGS. 3 and 4) formed of, in the embodiment here specifically described, and as shown in the upper right corner of FIG. 4, sixty-four sequence patterns (only three of which are disclosed in FIG. 4) arranged in eight banks of eight sequence patterns each. Each sequence pattern accepts sequence tempo data 20 and sequence pattern data 22. The sequence tempo data 20 defines the relative time for the smallest rhythmic value to be included in that sequence, and the entire sequence will have that tempo. The sequence data 22 represents the pattern or program of strong/weak beats in that particular sequence. That pattern may be short or long, depending upon the musical piece in question, and hence the sequence pattern memory portion 22 is completed. When that particular sequence pattern ends, sequence length data 24 is generated. When the tempo of the musical piece shifts, the new sequence tempo and the new sequence pattern are entered into another sequence pattern memory 22. Each sequence pattern memory has a link location 26 which either identifies the location in memory of the next sequence to be reproduced or indicates that the string of sequences has come to an end.

One concept that has been utilized in the design is the use of "dynamic memory allocation" for sequence storage. Memory is allocated to locations according to the amount of memory needed for that specific sequence. Sequence memory length is not fixed and predetermined. No memory goes unused simply because one sequence is shorter than another. This is a more efficient use of memory. Sequences never shift location within the memory; software pointers direct commands to sequence information as needed.

Data is inserted into the memory 18 through the keyboard 6. Each memory bank location has an identifying number, e.g., 1–8, and within each bank each sequence location has an identifying number (e.g., 1–8). To record a particular sequence pattern into the memory at bank 1, sequence 1, the operator will depress the "SEL BANK" key and the "1" key. To record the first metric sequence, the operator will then depress the "SEL SEQ" key and the "1" key. The metronome is then ready to receive data in sequence 1 of bank 1.

The data to be inserted into that sequence is its tempo and its beat pattern. The tempo is defined by a standardized number representing the relative frequency of the smallest metrical value that the metronome will produce for that sequence. For example, if one wants a quarter note to equal 120, but wishes the metronome beats to correspond to eighth notes, the tempo setting should be 240. If the beats are to represent quarter notes in triplets, the tempo should be set at 360. This data is inserted into the memory by pressing the "PROG TEMPO" key and then the appropriate numerical keys.

The actual beat pattern for sequence 1 is inserted into the memory by depressing the "PROG BEATS" key and then the "STRONG" and "WEAK" keys in the desired sequence. For example, if all strong beats are required for a total of twenty beats, the "STRONG" key is depressed twenty times. If alternated strong and weak beats are desired, the appropriate keys are pressed alternately. Any desired combination of strong and weak beats is reproduced in the memory by corresponding sequential depression of the appropriate keys, without regard to the actual time that elapses between the pressing of one key and the next.

There is no requirement as to whether tempo data or beat pattern data be inserted first.

When that sequence has been completely recorded in memory, the next succeeding sequence having a different basic tempo, which may be identified as "sequence 2", is then inserted into memory by pressing the "SEL SEQ" and "2" keys and repeating the steps described above. This is repeated (up to a limit, as here disclosed, of eight sequences) until the entire passage has been programmed. It should be noted that sequences need not be recorded in the same order in which they are to be reproduced—"sequence 4" may be recorded after "sequence 1", followed by recording of "sequence 3" and then "sequence 2", for example.

Next, the individual sequences must be linked so that the entire passage can be played. Assuming that sequences 1–8 are to be played in that order, the operator would press the "LINK" button followed by the "1" and "2" buttons, he would then press the "LINK" button and the "2" and "3" buttons, and so on until he has pressed the "LINK", "7" and "8" buttons. If one wishes to link sequences in other than the numerical order they assume in memory, that can be accomplished simply by pressing the appropriate non-consecutive numerical buttons after pressing the "LINK" button.

Other passages may be recorded in other banks by following the same procedure but first depressing the "BANK" button and the appropriate bank number button.

To play a given passage or any desired part thereof, the user will first identify the bank desired by pressing the "SEL BANK" button and the appropriate number and then press the "PLAY FROM" button and the number button identifying the first sequence of that bank to be reproduced, which may or may not be the initial sequence of the bank. The metronome will then, from the loud speaker 4, emit strong and weak sounds in proper time and pattern as determined by the data in the selected sequence and all sequences in that passage to the end of the passage. If that portion of the passage is to be repeated, the operator will initially press the "REP FROM" button instead of the "PLAY FROM" button. If, at any time, the operator wishes to stop the metronome, he will press the "STOP CANCEL" button.

To increase or decrease the playback rate of the entire passage, the tempo control knob 12 is turned in one direction or the other. This will have the effect of multiplying the programmed tempos by a common factor resulting in an increase or decrease in the rate of playback of the entire passage. Ratios of tempos of the sequences within the passage remain constant. Hence, linked sequences will maintain the same metrical relationships, regardless of the playback rate of the entire passage. Position of the playback knob 12 is irrelevant at the time of programming.

Once an individual sequence has been linked to other sequences, its individual tempo, as well as its sequence pattern, may be changed as desired without affecting its linkages to the other sequences or the content of the other sequences, simply by reprogramming that particular aspect of the sequence, beginning from the "SEL SEQ" step.

The "COPY" button is used as a time-saving device to copy one sequence to another sequence so that it may be linked later on. For example, while working in a given identified bank, by pressing "COPY", then "1", then "3", the pattern of sequence 1 is copied into sequence 3 without adversely affecting the memory storage in sequence 1.

At any time in the play mode, weak beats may be inhibited by throwing the weak beat switch 14 to its "off" position. This will allow only the strong beats to be heard. This is helpful after a passage has been practiced slowly and the tempo is then speeded up, or for exploring the flow or feel of a passages.

The metronome is also capable of functioning as a fixed meter device, producing only a single type of beat at a fixed tempo. For this operation, the "STD MET" button is pressed followed by the numerical buttons to indicate the desired tempo. The range of standard metronome tempo may be 30–250 beats per minute.

If only one sequence is to be played, after it has been recorded the "PLAY" button is pressed for playback followed by the identifying number of the sequence, and if that sequence is to be constantly repeated, the "REPEAT" button is pressed instead of the "PLAY" button.

FIG. 3 is a block diagram of the flow data within the system. The master control or microprocessor is represented in part by block 48. The "user functions" block 51 represents the keyboard 6. The programmable random access memory 18 includes the sequence tempo data 20, the sequence length data 24, sequence pattern data 22 and the sequence link data 26, these corresponding repsectively to memory space 20, memory space 24, memory space 22 and memory space 26 in FIG. 4. The sequence tempo data 20, and the setting of the tempo control knob 12, determines the playback rate, which in turn determines the setting of the pause length counter 60, which receives the repetitive signal from the timer 32, and, when appropriate, produces a "next beat" signal 62 which is sent to the microprocessor 48, causing the microprocessor to send a signal to the beat generator 64, thus producing an audible beat from the speaker 4. The "next beat" signal 62 also steps the sequence length counter 66 which combines this signal with the sequence length data 24 in the random access memory to determine when a "next sequence" signal 68 will be produced, that signal being processed by the microprocessor which will address the next linked sequence in random access memory. The "next sequence" signal also steps a passage counter 70 which combines this signal with the sequence linkage data 26 in the random access memory to, at an appropriate time, produce an "end of passage" signal 72 which will cause the microprocessor to stop the production of audible beats. The sequence pattern data 22 in the random access memory for the particular sequence being reproduced will be combined (by the microprocessor) with the signal from the "weak beats" switch 14 to determine whether the sound produced by the speaker 4 will be that which represents a weak beat, a strong beat or a rest (no beat). The pause length counter 60, sequence length counter 66, and passage counter 70 are all preferably physically part of the microprocessor 48 (specifically implemented as data locations in its internal random access memory (not shown), but are here shown separately for clarity of understanding.

FIG. 4 is a logic diagram schematically illustrating the way in which the metronome performs its functions (flow of control). As has been set forth, the metronome, in addition to the programmable random access memory 18, is provided with a microprocessor generally designated 48 which controls the operations of the system. One element of that microprocessor is a master clock 30 which, for timing purposes, provides a sequence of timing signals to a programmable interval timer 32 converting the high frequency output of the master clock 30 to a repetitive signal at a predetermined frequency such as 1 microsecond. That signal activates that part of the microprocessor represented by box 34, which reads data from the pause length counter 60 and determines from the pause length counter 60, the sequence tempo data 20, and the positions of the playback rate knob 12 whether it is time to produce the next beat (box 38). If it is time, the "Yes" line 40 is followed, and the microprocessor performs the actions in box 28, addressing the random access memory 18 to generate the appropriate signal, which is passed to the speaker to sound a beat, then determining from the sequence length counter 66 and the passage counter 70 whether the end of sequence and/or end of passage has been reached, and setting the appropriate counters if necessary. If it is not time to do a beat, or after the actions in box 28 have been performed, the microprocessor determines if there has been any input from the keyboard indicating that the user wishes to change parameters or stop the playback (box 42). If user changes are desired, the "Yes" line 44 is followed, and the system reads data from the keyboard and performs the necessary changes (box 46). If no relevant user input has been received, or when the changes as have been requested have been performed, the pause length counter 60 is decremented as indicated by box 36, reflecting that one timing interval has passed, and the microprocessor returns to a dormant state to wait for the next signal from the programmable interval timer 32.

Figure 5A:
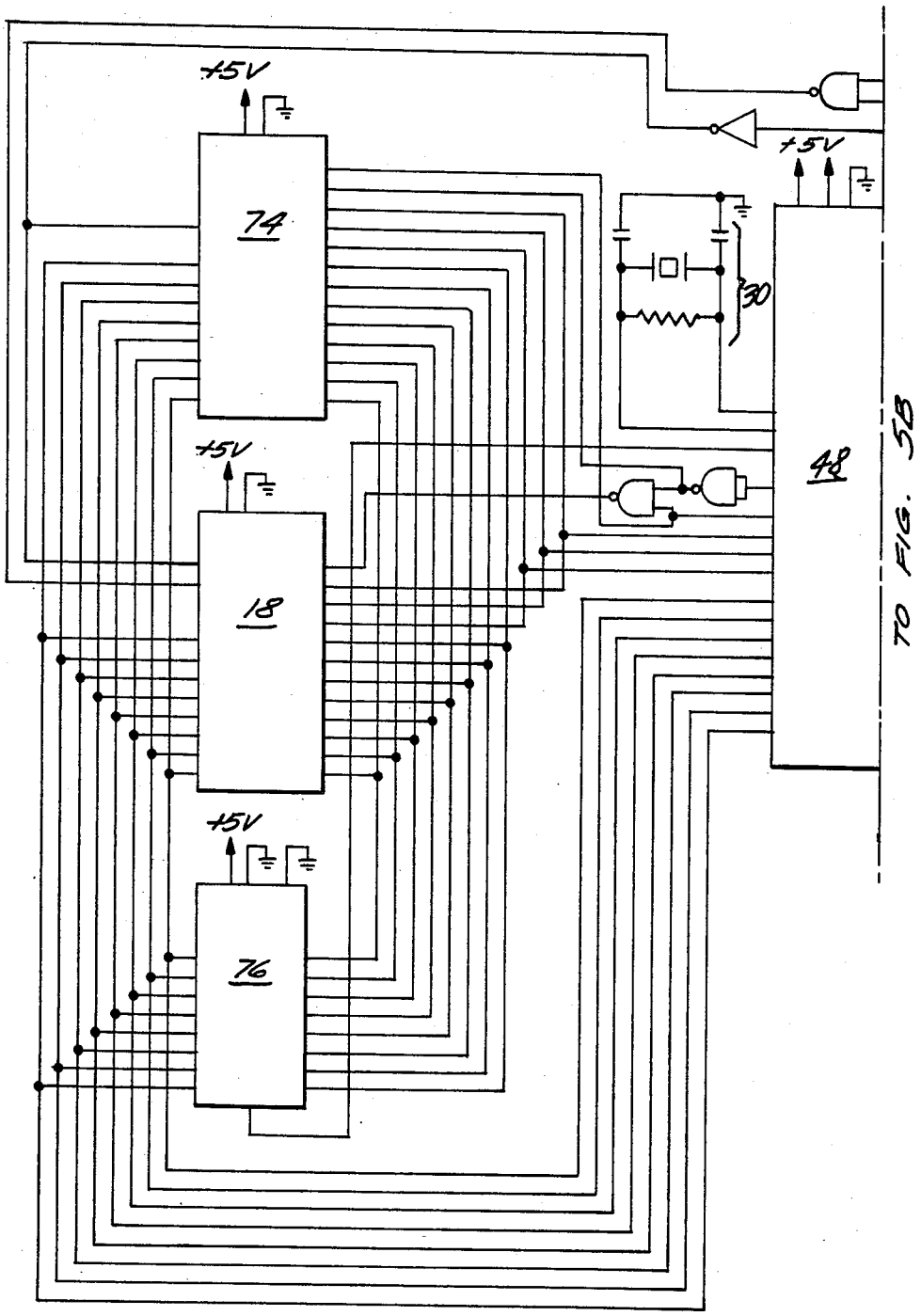
FIGS. 5A and 5B constitute a typical circuit diagram for the metronome.
Figure 5B:
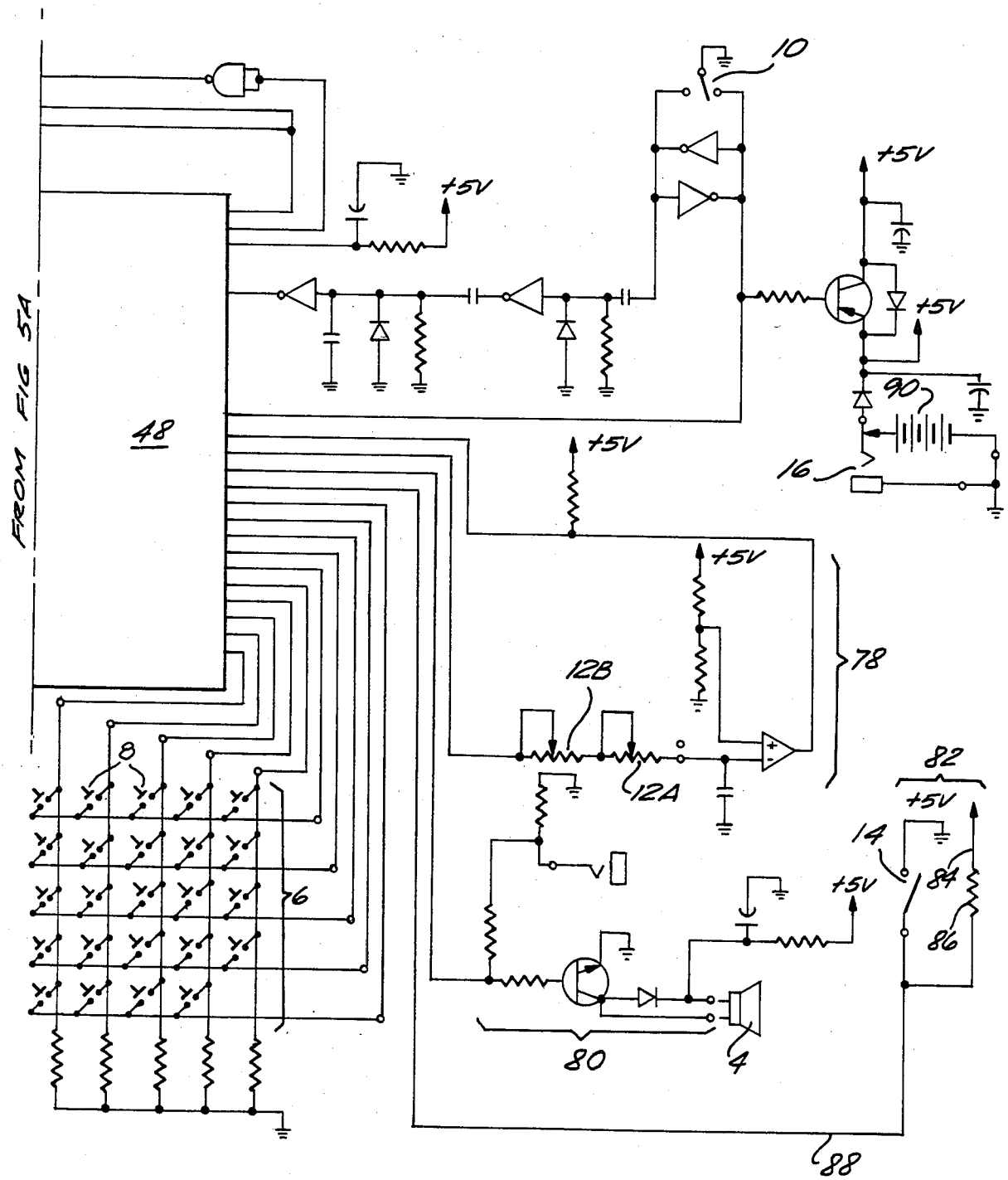

FIGS. 5A and 5B constitute a typical circuit diagram. The keyboard 6 is connected to the microprocessor 48. The permanent data storage for the microprocessor 48 is accomplished in the EPROM 74. Block 76 is a latch unit processing the gating. Block 18 represents the random access memory for the programmed data. The crystal clock generator 30 feeds into the microprocessor 48, as do various data lines from the units 74, 18 and 76. The output from the keyboard 6 is also fed to the microprocessor 48, which controls the transmission of the keyboard output to the random access memory 18 and to the relevant portions of the microprocessor control circuitry. The adjustable tempo control knob 12 actuates a potentiometer 12*a* which, together with a calibration potentiometer 12*b* and the output of the tempo circuit 78, feeds back to the microprocessor 48 for appropriate beat tempo control. The speaker 4 is actuated by circuit 80, the input to which comes from the microprocessor 48. Whether a beat sound is called for is determined by the data 22 in the random memory, and whether weak beats are produced is determined by circuit 82 in which weak beats are produced (when ordered by the sequence pattern 22) when the 5-volt supply to the line 84 and resistor 86 is effective on the line 88; however, when switch 14 is closed that 5-volt potential is shorted to ground, thus reducing energization to line 88 and hence inhibiting the production of an ordered weak beat. The switch 10 is the power-on switch and, as here specifically disclosed, AC energization is accomplished via the jack 16. A battery 90 may be provided to maintain energization of specific parts of the system, and hence prevent loss of memory, when the jack switch 16 is disconnected from the external AC power source.

A more detailed description of the specific circuitry and of the internal workings of the various blocks illustrated is not believed to be necessary, in view of the fact that those blocks represent standard commercial items and the manner in which they may be programmed is common knowledge in connection with the use of data processing equipment. Purely by way of example, the microprocessor 48 may be a unit identified as 146805E2, the block 74 may be a 4K EPROM identified as 27C32, the unit 76 may be a latch identified as 74HC373, and the random access memory 18 may be a 2K RAM identified as 6116. The "+5V" legend represents the voltage applied at the indicated points when the power switch 10 is switched on.

It will be appreciated from the above that with the metronome of the present invention the musician may program a virtually unlimited variety of beat meters, varying in frequency and/or rhythm pattern, with the various beat programs being stored in memory and available for selective use when and as desired. The programming is accomplished simply, and does not require input in the actual rhythm desired, but only input identifying the desired sequence of strong and weak beats plus identification of the desired frequency of those beats. Programming of a sequence continues for as long as the frequency is unchanged; the rhythmic pattern can be changed at will as the sequence progresses simply by varying the identification of the sequence of strong and weak beats. When the tempo changes, a new sequence is recorded for that new tempo, which new sequence is subsequently linked to the original sequence if it is desired that the metronome produce beats for those two sequences one after the other. In this way the musician can program and reprogram the metronome as his musical requirements dictate.

It will be appreciated that while but a single specific embodiment of the present invention has been here disclosed, many variations may be made therein, all within the spirit of the invention as defined in the appended claims.

I claim:

1. A metronome comprising means for producing beat indications and means for actuating said indication producing means, said actuating means comprising a programmable memory the program of which represents a sequence of beats and the relative frequency of said beats, keyboard means operatively connected to said memory for programming it, and control means for operatively connecting said memory to said indication producing means to cause the latter to produce beats in accordance with said memory program.

2. The metronome of claim 1, in which said keyboard means is effective to erase an existing program in said memory when a new program is to be placed into memory.

3. The metronome of claim 1, in which a given program comprises sequential sets of beat indication orders and individual relative frequency orders for each of said sets.

4. The metronome of claim 3, in which said keyboard means is effective to input into said memory, for each of said sets, beat orders and time frequency orders, and for ensuring that said sets output sequentially on command.

5. The metronome of claim 3, in which said keyboard means is effective to input into said memory, for each of said sets, beat orders and time frequency orders, and for ensuring that said sets output separately on command.

6. The metronome of claim 1, in which said control means is also effective to cause a given set of beat indication orders to repeat.

7. The metronome of claim 3, in which said control means is also effective to cause a given group of sequential sets to repeat.

8. The metronome of claim 1, in which said memory comprises a plurality of keyboard-produced programs, and in which said control means is effective when appropriately activated to render a given program operative to produce beat indications.

9. The metronome of claim 1, in which said program includes data for two types of beats, and in which said control means is effective when appropriately actuated to inhibit the production of one of said types of beats without inhibiting the production of the other of said types of beats.

10. The metronome of claim 1, in which the control means is effective when appropriately actuated to reproduce as a given sequence a program existing as another sequence.

11. The metronome of claim 1, in which said programmable memory comprises means for recording a plurality of sequences of beats and for producing beats corresponding to said sequences in an order of sequences not necessarily corresponding to the order in which they are recorded.

12. In the metronome of claim 1, means for controllably altering the relative frequency of the produced beats from that recorded in said program while retaining the rhythmic relationship of said beats.

13. A metronome comprising means for producing beat indictions and means for actuating said indication producing means, said actuating means comprising a programmable memory the program of which represents a sequence of beats, keyboard means operatively connected to said memory for programming it, and control means for operatively connecting said memory to said indication producing means to cause the latter to produce beats in accordance with said memory program, in which a given program comprises sequential sets of beat indication orders and individual relative frequency orders for each of said sets.

* * * * *